United States Patent [19]

Walter et al.

[11] Patent Number: 5,021,014

[45] Date of Patent: Jun. 4, 1991

[54] BUS BAR ASSEMBLY

[76] Inventors: Gerard S. Walter, 2625 Middle Rd., Glenshaw, Pa. 15116; John Hagan, Hardies Rd., Gibsonia, Pa. 15044

[21] Appl. No.: 519,640

[22] Filed: May 7, 1990

[51] Int. Cl.[5] ..... H01R 11/26

[52] U.S. Cl. ..... 439/798; 439/812

[58] Field of Search ..... 439/797, 798, 810, 812

[56] References Cited

U.S. PATENT DOCUMENTS

| | | | |
|---|---|---|---|
| 1,913,552 | 6/1933 | Jackson . | |
| 1,926,927 | 9/1933 | Woertz | 175/369 |
| 2,232,602 | 2/1941 | Grace | 173/324 |
| 2,288,941 | 7/1942 | Curtis | 240/78 |
| 2,290,691 | 7/1942 | Lemon | 24/243 |
| 2,569,223 | 9/1951 | Bowers | 173/324 |
| 3,047,835 | 7/1962 | Kelly | 339/242 |
| 3,210,716 | 10/1965 | Meacham | 339/21 |
| 3,335,399 | 8/1967 | Rys | 339/219 |
| 3,425,022 | 1/1969 | Walter et al. | 339/22 |
| 3,551,876 | 12/1970 | Walter | 339/21 |
| 3,727,171 | 4/1973 | Coles | 339/22 |
| 3,836,941 | 9/1974 | Izraeli | 439/810 X |
| 4,231,633 | 11/1980 | Luke | 339/242 |
| 4,500,161 | 2/1985 | Keglewitsch | 339/242 |
| 4,640,571 | 2/1987 | Walter | 339/242 |
| 4,778,412 | 10/1988 | Walter et al. | 439/798 |

FOREIGN PATENT DOCUMENTS

| | | |
|---|---|---|
| 736704 | 6/1943 | Fed. Rep. of Germany . |
| 888909 | 12/1943 | France . |
| 692707 | 6/1953 | United Kingdom . |

*Primary Examiner*—Eugene F. Desmond

*Attorney, Agent, or Firm*—Buchanan Ingersoll; Michael L. Dever

[57] ABSTRACT

An electrical bus bar assembly is provided in which an elongate conductor member having at least one generally flat surface with two spaced generally parallel channels having an opening through the flat surface narrower than a major section of the channel parallel to the flat surface and separate by a riser member extending above said surface are provided with at least one connector module made up of a top member with two depending legs bent inwardly at the end remote from the top member and terminating adjacent the riser member and having a foot member on each slidably engaged in the parallel channels through said opening, and clamp means in the top member acting to exert pressure on a wire inserted between the legs and on the riser to fix the wire in the connector module and the connector module in tight conductive relation on the conductor member. Lips provided on the legs interact with grooves provided on a T-shaped member to prevent the foot members from spreading apart.

4 Claims, 1 Drawing Sheet

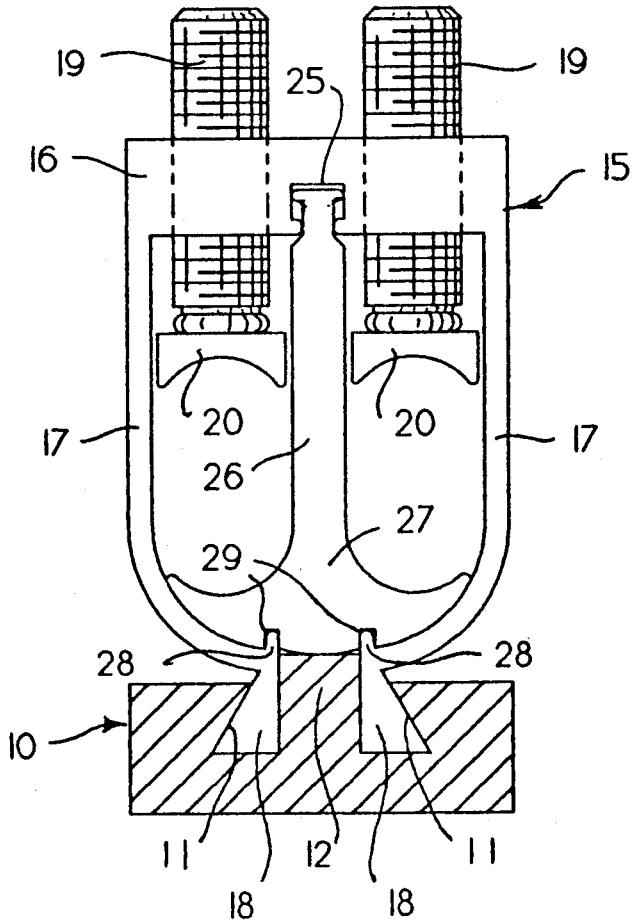
19
19
25
16
15
20
20
17
17
26
27
29
28
28
10
11
12
11
18
18

BUS BAR ASSEMBLY

BACKGROUND OF THE INVENTION

1. Field of the Invention

The present invention relates to bus bar assemblies and particularly to an improved bus bar assembly which can be as long as necessary and provides modules which may take different sizes and be connected to an elongated conductor to form a single integral unit.

2. Description of the Prior Art

In the past it has been the practice to connect heavy conductors to a bus bar using wire clamps with a screw type clamp to apply connecting pressure to the conductor. Typical of such prior art connectors are those illustrated in U.S. Pat. Nos. 1,913,552; 2,232,602; 2,288,941; 2,290,691; 2,569,223; 3,047,835; 3,335,399; earlier Walter U.S. Pat. Nos. 3,425,022 and 3,551,876 and in French patent 888,909; British patent 692,707 and German patent 736,704. Those earlier patents, while excellent for their time and purpose were limited in number and variety of wire connections that they could be used to make and were difficult to assemble to a bus bar.

U.S. Pat. No. 4,778,412, which issued to the applicants herein, discloses a bus bar assembly which can connect large numbers of wires to a single bus bar using single and double connector modules, each of which is readily movable and spaced along the length of the bus bar and fixed in position as the wires are compressed and connected in the connector modules. Such an assembly has particular utility in large buildings where large numbers of wires must be connected.

U.S. Pat. No. 4,778,412 provides an electrical bus bar assembly comprising an elongate conductor member having a generally flat top surface with two spaced parallel channels extending lengthwise of the conductor and separated by a vertical riser forming an integral part of the conductor and extending above the top surface of the conductor member and forming adjacent walls of the spaced channels, at least one wall of each channel extending upwardly and inwardly from the bottom of the channel at an angle to form an opening smaller in width than the bottom of the channel, at least one connector module adapted to receive at least one wire slidable in said channels, said connector module having a top member and two depending legs at each side, each leg having a depending foot member opposite the top member with a cross section corresponding to one of the channels in the conductor member and slidable therein, said depending foot members being separated to receive the vertical riser therebetween, a screw member threaded in said top member extending between the legs and a clamp member pivoted on the end of the screw member between the depending legs for clamping a wire between the clamp member, the riser and at least a part of the depending legs to clamp the wire and to cause the connector module to be forced upwardly to frictionally engage the depending foot members in the two spaced channels of the elongate conductor member. Preferably each leg is turned inwardly at the end opposite the top member and provided with a depending foot member. The top member of the connector member may be provided with a channel extending transversely thereof intermediate the legs and parallel thereto and having the step of a generally T shaped member slidable therein, said head having curved surfaces on each side of the step and on the top cooperating with curved surfaces in the depending legs, said top contacting the top of the vertical riser, and at least one screw member threaded in said top member between each leg and the stem of the T shaped member and carrying a clamp member pivoted thereon between each depending leg and the stem of the T shaped member. Preferably the elongate conductor member is extruded aluminum.

SUMMARY OF THE INVENTION

Applicants' present invention is an improvement to their bus bar assembly disclosed in U.S. Pat. No. 4,778,412. Applicants have discovered that the foot members depending from the legs on each side of the connector may spread apart in response to the compression of the wires underneath the clamp member. In order to prevent the legs from spreading apart, applicants provide a lip on the inside of each of the legs above the feet and corresponding grooves in the generally T-shaped member. The lips of the legs engage the grooves of the T-shaped member, thereby preventing the feet from spreading apart.

BRIEF DESCRIPTION OF THE DRAWINGS

The drawing is a front sectional view of a presently preferred embodiment of the bus bar and connector assembly according to this invention.

DESCRIPTION OF THE PREFERRED EMBODIMENTS

Referring to the drawing, I have illustrated a bus bar 10 in the form of an elongate conductor of generally rectangular shape with a pair of channels 11 separated by an integral riser 12 extending the full length of the conductor. One wall of each channel 11 extends upwardly and inwardly toward the riser at an angle to form an opening at the top smaller than the bottom of the channel. These channels are adapted to receive connector modules 15, made up of a top member 16 and two depending generally parallel legs 17 which are curved inwardly toward riser 12 and provided with a foot member 18 having a section generally corresponding to channels 11 and adapted to slide in said channels. The riser 12 extends above the top of bus bar 10 and between legs 17 and has a rounded top surface corresponding to the contour of the curved ends of legs 17. Lips 28 extending into connector module 15 are provided on legs 17 immediately above depending foot member 18.

The top member 16 is provided with a groove 25 extending intermediate and parallel to legs 17. The end of stem 26 of a generally T shaped member is slidably engaged in the this groove 25. The head 27 of the generally T shaped member is of crescent shape and slidably engages the head of riser 12 and the inside curved walls of legs 17. A screw member 19 is provided in the head member 16 intermediate stem 26 and each leg 17 and is fitted with a pivoted clamp member 20. Grooves 29 are provided on the head of the T and correspond to lips 28 on legs 17.

In operation, wires are inserted between the head of the T and each clamp member 20 and screws 19 are turned to force the clamp member 20 against the wire which in turn puts pressure on head 27 of the T shaped member which there presses against the top of riser 12 forcing foot members 18 into tight engagement with channels 11 as the top member 16 is forced upwardly by screws 19. This engages the wire tightly and fixes the conductor module in place on bus bar 10 with a tight conductive contact. Grooves 29 interact with lips 28 to prevent foot members 18 from spreading apart during compression of the wires by clamp members 20.

In the foregoing specification certain preferred practices and embodiments of this invention have been set out, however, it will be understood that the invention may be otherwise embodied within the scope of the following claims.

We claim:

1. An electrical bus bar assembly comprising an elongate conductor member having a generally flat surface with two spaced parallel channels extending lengthwise thereof, a riser member extending above the flat surface of said conductor member between said channels and forming adjacent walls of each, at least one wall of each channel extending upwardly at an angle from the bottom of the channel to form an opening in the flat surface of the conductor member smaller in width than the bottom of the channel, at least one connector module having a top member and depending legs at each side, each leg having a depending foot member remote from the top member with a cross section corresponding to the cross section of the channels in the conductor member and slidable through the opening, said foot members being separated to receive the riser therebetween, a screw member threaded in the top member and extending between the legs and a clamp member pivoted on the end of the screw member between the depending legs for clamping a wire between the clamp member and riser and the depending legs where the connector module is forced away from the flat surface of the conductor member causing the foot members to tightly engage the channels, wherein the top member of the connector module has a first groove intermediate and parallel to the legs, a generally T shaped member having a stem with a transverse head at one end, the other end of said stem being slidable in said first groove and the head bearing on and slidable on the riser of the elongate member and on adjacent portions of said legs, wherein each of said legs are provided with a lip and said transverse head of said T shaped member is provided with a pair of second grooves adapted to receive said lips on said legs and prevent said foot members from spreading apart.

2. An electrical bus bar as claimed in claim 1 wherein the transverse head has a generally crescent shape.

3. An electrical bus bar assembly comprising an elongate conductor member having a generally flat surface with two spaced parallel channels extending lengthwise thereof, a riser member extending above the flat surface of said conductor member between said channels and forming adjacent walls of each, at least one wall of each channel extending upwardly at an angle from the bottom of the channel to form an opening in the flat surface of the conductor member smaller in width than the bottom of the channel, at least one connector module having a top member and depending legs at each side, wherein the legs extend in parallel relationship from the top member and are curved toward each other at the end remote from the top member, terminating adjacent the riser member, each leg having a depending foot member remote from the top member with a cross section corresponding to the cross section of the channels in the conductor member and slidable through the opening, said foot members being separated to receive the riser therebetween, a screw member threaded in the top member and extending between the legs and a clamp member pivoted on the end of the screw member between the depending legs for clamping a wire between the clamp member and riser and the depending legs where the connector module is forced away from the flat surface of the conductor member causing the foot members to tightly engage the channels, wherein the top member of the connector module has a first groove intermediate and parallel to the legs, a generally T shaped member having a stem with a transverse head at one end, the other end of said stem being slidable in said first groove and the head bearing on and slidable on the riser of the elongate member and on adjacent portions of said legs, wherein each of said legs are provided with a lip and said transverse head of said T shaped member is provided with a pair of second grooves adapted to receive said lips on said legs and prevent said foot members from spreading apart.

4. An electrical bus bar as claimed in claim 3 wherein the transverse head has a generally crescent shape.

* * * * *